United States Patent [19]

Biordo

[11] Patent Number: 4,668,159

[45] Date of Patent: May 26, 1987

[54] COMPRESSED ROTATIVE MOTOR

[76] Inventor: Jose M. Biordo, Galan St. El Palomar, Buenos Aires, Argentina

[21] Appl. No.: 756,656

[22] Filed: Jul. 19, 1985

[51] Int. Cl.[4] ..... F01D 15/06

[52] U.S. Cl. ..... 415/74; 415/75; 415/185; 415/199.5; 415/196; 415/503

[58] Field of Search ..... 415/71-75, 415/76, 90, 143, 186, 190, 185, 198.1, 187, 199.5, 502, 503, 196, 197; 433/132

[56] References Cited

U.S. PATENT DOCUMENTS

| | | | |
|---|---|---|---|
| 1,112,008 | 9/1914 | Holdsworth | 415/199.5 X |
| 1,654,605 | 1/1928 | Rood | 415/190 |
| 1,902,439 | 3/1933 | Foss | 415/75 |
| 3,128,079 | 4/1964 | DeGroff | 415/199.5 X |
| 3,609,058 | 9/1971 | Tarsoly | 415/503 X |
| 3,758,228 | 9/1973 | Post | 415/503 X |

FOREIGN PATENT DOCUMENTS

| | | | |
|---|---|---|---|
| 283827 | 11/1927 | Fed. Rep. of Germany | 415/503 |
| 929668 | 7/1955 | Fed. Rep. of Germany | 415/503 |

*Primary Examiner*—Robert E. Garrett
*Assistant Examiner*—Joseph M. Pitko
*Attorney, Agent, or Firm*—Anthony A. O'Brien

[57] ABSTRACT

A compressed air rotary motor includes high and low pressure rotors having peripheral helicoidal threads. The rotors are sandwiched between a circular plate and end wall while an intermediate wall separates the two rotors. Fluid passageways in the plate and two walls control the flow of compressed air initially to a single gap between two threads of the high pressure rotor and thence to at least two gaps between a plurality of adjacent threads of the low pressure rotor following which air is delivered to an annular channel in the end wall prior to exiting the motor.

3 Claims, 1 Drawing Figure

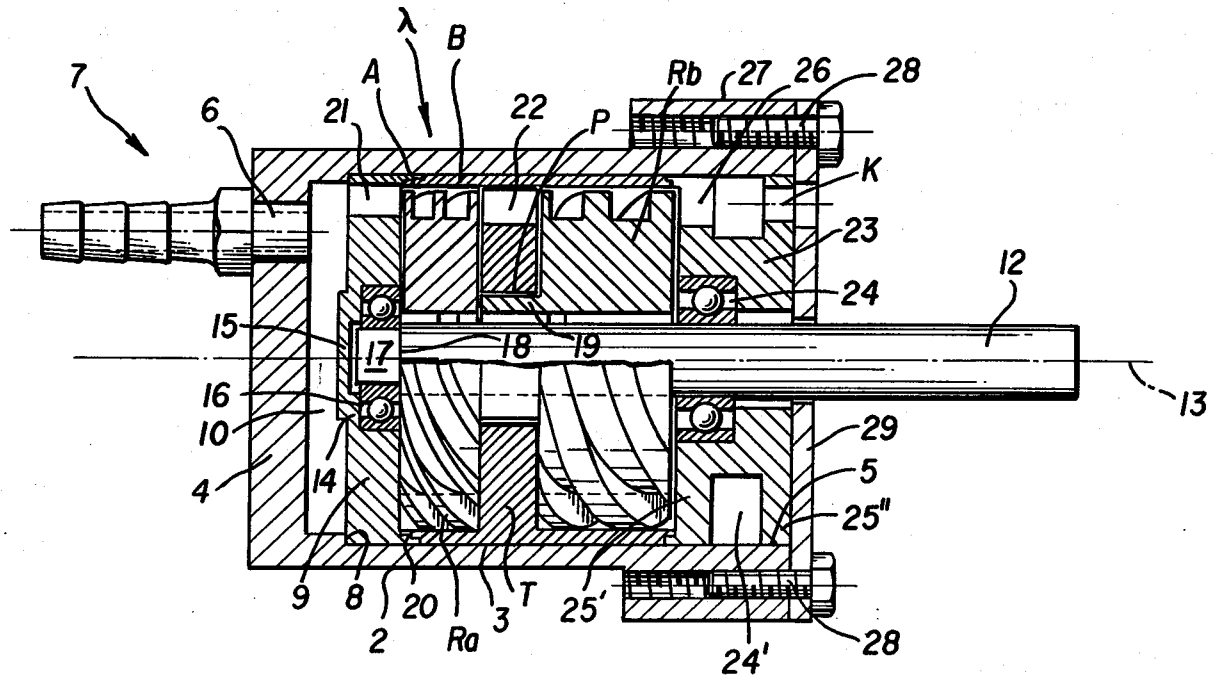
13
12
28
K
23
24
29
5
25"
28
26
27
Rb
24'
P
19
25'
22
18
T
3
B
Ra
λ
20
A
17
2
21
8
14
9
6
15
16
10
4
7

COMPRESSED ROTATIVE MOTOR

BACKGROUND OF THE INVENTION

This invention refers to a compressed air rotary motor, particularly adaptable for high velocity drilling machines.

Several types of compressed air motors are known in respective industries, including the rotary types. Nevertheless, a shortcoming of many known such types of motors is that it is not feasible to obtain high angular velocities because such devices demand high pressures with the consequence of high heating which leads to numerous problems prohibiting or simply making impossible the use of such motors.

SUMMARY OF THE INVENTION

One of the objects of the present invention consists of providing a compressed air rotary motor particularly adaptable for high velocity drilling machines.

Another object of the present invention consists of providing a high velocity compressed air device comprising a motor including high and low pressure rotors arranged in a case with separating walls having fluid passageways controlling movement of compressed air through the motor in a manner providing maximum speed to an output shaft with minimum heat generation.

BRIEF DESCRIPTION OF THE DRAWING

These and other objects of the present invention are disclosed in the following description. In order to obtain a more clear understanding, a preferred and non-restricted embodiment is illustrated in the enclosed drawing, which represents a longitudinal sectional view along the motor axis, with portions of the rotors shown in elevation.

DESCRIPTION OF THE PREFERRED EMBODIMENT

According to the drawing, the motor includes a housing or case 1 which has the form of a cylinder on its external wall or surface 2 as well as its internal wall or surface 3. The case is provided with a closed first end wall 4 preferably integral with the case cylindrical walls 2, 3. The opposite end of the case presents an open second end or case mouth 5.

The end wall 4 is provided with a conduit or passageway 6 having a circular internal section to which is coaxially connected a nozzle 7, externally corrugated, serving as a compressed air inlet.

The internal cylindrical surface 3 will be seen to include a rearwardly facing annular shoulder 8 against which a coaxially disposed circular plate 9 is seated to form an inlet chamber 10. The circular plate 9 presents a medial, cylindrical, flattened recess 11, coaxial with both a mechanical axle or output shaft 12 and the geometrical center axis 13 and, naturally, coaxial with the case 1, end wall 4 and circular plate 9. Additionally, the flattened recess 11 presents in its bottom a counterbore or cylindrical recess 14 having a diameter and depth smaller than the diameter and depth of the cylindrical recess 11, respectively.

A ball bearing 16 contained in the lateral cylindrical surface of the flattened recess 11 supports the spindle 17 which is coaxial and integral with the shaft axle 12. The diameter of the spindle 17 is smaller than the balance of the axle 12 and forms an annular shoulder 18 therebetween. Fixedly mounted on the shaft 12, such as by a wedge or key, is a first rotor or high pressure rotor Ra. This rotor Ra is provided with helicoidal threads X on its periphery. On the same shaft or axle 12 is a similarly mounted second rotor or low pressure rotor Rb likewise provided with peripheral helicoidal threads X'. The rotor Rb includes a cylindrical coaxial prolongation 19. This prolongation 19 will be understood to comprise an integral extension of the rotor Rb and thus is likewise fixed relative the shaft 12. .

A substantial portion of the case interior surface 3 is engaged by a sleeve B, formed in such a manner that the sleeve B remains integral to the case 1. A disk-like intermediate wall T, which is coaxial with the axis 13, is integrally formed with the sleeve B and includes a central bore or perforation P which coaxially receives the cylindrical prolongation 19, in such a manner that the prolongation can rotate freely with respect to the stationary disk-like intermediate wall T. The two circular parallel faces of the wall T comprise respective normal sections of the cylinder associated with the internal surface of the sleeve B.

The sleeve B includes an annular recess 20 at its forward end and which cooperates with an annular edging A extending rearwardly from the outer perimeter of the plate 9.

The plate 9 is provided with a fluid passageway or conduit 21 which is configured to encompass that space presented by the helicoidal gap formed between two adjacent ones of the rotor threads X, during each revolution rotor Ra.

On the other hand, the intermediate wall T is provided with a fluid passageway or conduit 22 which is configured to encompass that space presented by at least two helicoidal gaps formed by a plurality of adjacent ones of the rotor threads X', during each revolution of the rotor Rb.

The drawing shows also a solid cylindrical piece or second end wall 23, integral with the sleeve B and thus fixed relative the case 1. Between the axle 12 and the second end wall 23 is placed a ball bearing 24. The end wall 23 includes an annular channel 24' coaxial to the axis 13 and bounded by two flattened circular rings 25' and 25''. The innermost flattened circular ring 25' includes an open slot or passageway 26 allowing the flow of air from the helicoidal gaps of the low pressure rotor Rb into the cavity 24' formed by the annular channel, and thence from this cavity to a plurality of outlet orifices K, only one of them being visible in the drawing.

The exterior surface 2 of the case 1 is surrounded by an integral annular and coaxial projection 27 which removably receives two screws 28 diametrically opposed in position. These screws 28 removably retain a holding rod 29 securing the assembled motor.

The described motor operates in the following manner:

Compressed air is supplied through the nozzle 7 and conduit 6 into the inlet chamber 10 and flows through the passageway 21 to feed the high pressure rotor Ra and by entering in a singular helicoidal gap between the threads X, during each single turn of the rotor. As the compressed air leaves the rotor Ra and enters the low pressure rotor Rb, it suffers an expansion, because the passageway or conduit 22 feeding the helicoidal gaps of the rotor Rb does not deliver to a single helicoidal gap during each turn, successively, but instead feeds to at least two helicoidal gaps, during each turn, successively. Consequently, the air pressure decreases.

Nevertheless, in spite of the fact that the pressure acting upon rotor Rb is considerably smaller than the pressure upon rotor Ra, the total operative surface of the helicoidal threads X' is larger than the respective total surface of the helicoidal threads X of rotor Ra, in such a manner that this relationship compensates and surpasses the effect of the pressure decrease. Thus, the force that is generated and consequently the motor movement in the shaft 12 are high, adding the power generated in the high pressure rotor Ra to that generated in the low pressure rotor Rb. In this way the axle 12 has a high angular velocity without increasing the pressure thereby avoiding the serious inconvenience associated with temperature elevation.

The flattened ring 25'' of the second end wall 23, when subjected to the air flow coming out through the slot 26, reacts in opposition to this air flow to avoid a thrust bearing since the wall is fixed relative the internal components of the case and escape means for the air is provided by the orifices K.

I claim:

1. A compressed air rotary motor comprising a case having a cylindrical cavity bounded by a closed first end wall and an open second end, a circular plate fixedly disposed within said cavity axially spaced from said first end wall to define an inlet chamber therebetween, compressed air inlet means through said case communicating with said inlet chamber, a sleeve within said cavity, an intermediate wall extending transversely within said cavity and fixed relative said sleeve, a second end wall adjacent said case open second end and fixed relative said sleeve, an axially disposed output shaft journaled in said circular plate and second end wall and projecting through said intermediate wall, a high pressure rotor having helicoidal threads fixed to said shaft between said circular plate and intermediate wall, a low pressure rotor having helicoidal threads fixed to said shaft between intermediate wall and said second end wall, a single passageway through said circular plate communicating compressed air from said inlet chamber to the periphery of said high pressure rotor, a single passageway through said intermediate wall communicating compressed air from said high pressure rotor to the periphery of said low pressure rotor, said circular wall passageway communicating at one end with a single gap between two adjacent threads of said high pressure rotor upon each revolution thereof, said intermediate wall passageway communicating at one end with two gaps between three adjacent threads of said low pressure rotor upon each revolution thereof, said second end wall provided with an annular channel, a passageway through said second end wall communicating compressed air from said low pressure rotor to said annular channel, and outlet means in said second end wall allowing air from said channel to exit said motor.

2. A compressed air rotary motor according to claim 1 wherein said low pressure rotor includes threads having a pitch greater than the pitch of threads provided on said high pressure rotor.

3. A compressed air rotary motor according to claim 1 wherein the gap between said threads on said low pressure rotor are axially greater than the gap between said threads on said high pressure rotor.

* * * * *